United States Patent [19]

Baik

[11] Patent Number: 4,687,896

[45] Date of Patent: Aug. 18, 1987

[54] 100 VOLT/220 VOLT COMPATIBLE ELECTROMAGNETIC INDUCTION HEATING COOKER

[75] Inventor: Haeng J. Baik, Seoul, Rep. of Korea

[73] Assignee: Gold Star Co., Ltd., Seoul, Rep. of Korea

[21] Appl. No.: 845,327

[22] Filed: Mar. 28, 1986

[30] Foreign Application Priority Data

Mar. 28, 1985 [KR] Rep. of Korea ..... 2058/1985

[51] Int. Cl.[4] ..... H05B 6/06

[52] U.S. Cl. ..... 219/10.77; 219/10.49 R; 323/300

[58] Field of Search ..... 219/10.77, 10.75, 10.49 R; 323/299, 300, 301, 303

[56] References Cited

U.S. PATENT DOCUMENTS 3,348,132 10/1967 Moyer et al. ..... 323/299
4,353,025 10/1982 Dobkin ..... 323/300
4,476,426 10/1984 Kishimoto et al. ..... 323/299 X
4,556,838 12/1985 Brasseur ..... 323/299 X
4,590,546 5/1986 Maile ..... 323/299 X

*Primary Examiner*—Philip H. Leung
*Attorney, Agent, or Firm*—Birch, Stewart, Kolasch & Birch

[57] ABSTRACT

An electromagnetic induction heating cooker compatible with both 100 V and 220 V inputs. A parallel circuit of a 100 V select switch and a transistor is connected between an output terminal of a bridge diode and a choke coil. The output terminals of the bridge diode and the choke coil are respectively connected to a pair of resistors in series whose values are set so that the same voltages are applied to a non-inverting and inverting input terminals of a comparator when the ratio of the output voltage of the bridge diode to that of the choke coil is 2.2:1. An oscillator, a drive, and a 220 V select switch are connected in series between an output of the comparator and the base of the transistor.

7 Claims, 3 Drawing Figures

FIG. 1 PRIOR ART
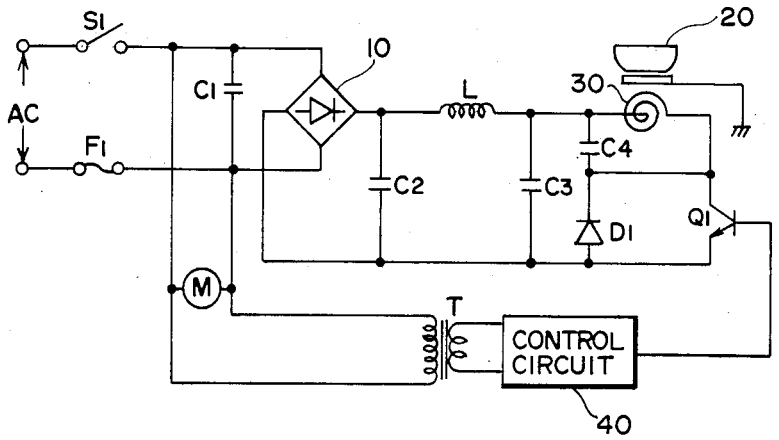
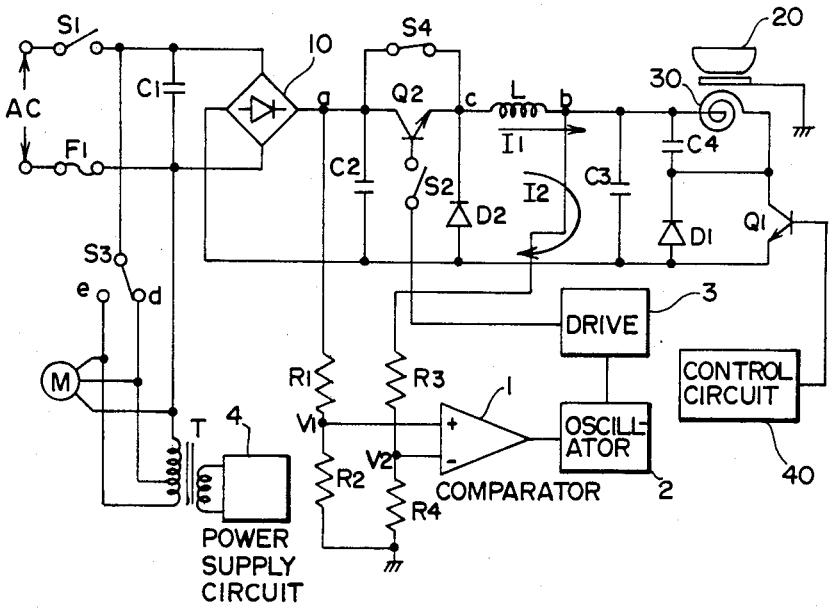
FIG. 2

100 VOLT/220 VOLT COMPATIBLE ELECTROMAGNETIC INDUCTION HEATING COOKER

BACKGROUND OF THE INVENTION

1. Field of the Invention

This invention relates to an electromagnetic induction heating cooker for a kitchen or cookery, and more particularly an electromagnetic induction heating cooker for using compatibly with the power supply of 100 volts and 220 volts by simple switching operation.

2. Description of the Prior Art

The conventional electromagnetic induction cooker generally tends to make it difficult to employ a transformer which can vary the voltage of power supply, since it has a consuming electric power of approximately 1.2 kilowatts while being of a small bulk or size and of a very light weight.

For example, in the prior art electromagnetic induction heating cooker as shown in FIG. 1, when the AC power supply is applied by the power when switch $S_1$ on, it is converted into DC fullwave pulsating current by a bridge diode 10. The plus or positive voltage of said pulsating current components converted in such manner is fed via the filter comprising a choke coil L and a capacitor $C_3$ to a resonant capacitor $C_4$ and a work coil 30 while the minus or negative voltage is coupled to both an emitter terminal of power transistor $Q_1$ and an anode of diode $D_1$. On the one hand, as the AC voltage is applied via a transformer T to the control circuit 40, a control signal is output from the control circuit 40 to swiftly perform the operation of turning on and off repeatedly, thereby directing a high-frequency current to a work coil 30.

Because a magnetic line of force is generated in an output coil 30 by such a high-frequency current, an induction current flows in the magnetic vessel or container 20 (what is commonly called an Eddy Current), which then is converted into heat by the skin resistance of the magnetic vessel 20 to heat the contents of the vessel.

However, such a prior art electromagnetic induction heating cooker has a drawback in that it can exclusively operate with a 100 volt AC power supply or a 220 volt AC power supply but it can not be compatibly used with an AC power supply of 100 volts and with an AC power supply of 220 volts.

OBJECT OF THE INVENTION

The present invention is suggested for the purpose of overcoming such a drawback of prior art devices.

Accordingly, it is an object of the present invention to provide an improved electromagnetic induction heating cooker which can be used compatibly with an AC power supply of 100 volts and with an AC power supply of 220 volts by simple switching operation.

SUMMARY OF THE INVENTION

The above object is obtained by the improved electromagnetic induction heating cooker according to the present invention wherein an 100 volt select switch and a transistor are connected between the output of bridge diode and a choke coil, and also the output of comparator for comparing and detecting the plus output voltage of bridge diode and the output voltage of choke coil is connected via a drive and a 220 volt select switch to the base of the transistor, thereby applying the same voltage to the work coil when the AC voltage of 100 volts is applied to close an 100 volt select switch or when the AC voltage of 220 volts is applied to close a 220 volt select switch.

BRIEF DESCRIPTION OF THE DRAWINGS

The foregoing and other objects and aspects of the present invention will be apparent from the following description of an embodiment with reference to the accompanying drawings in which:

FIG. 1 is a circuit diagram of the prior art electromagnetic induction heating cooker.

FIG. 2 is a circuit diagram of an 100 volt/220 volt compatible electromagnetic induction heating cooker according to the present invention.

DETAILED DESCRIPTION OF THE INVENTION

Figure 3:
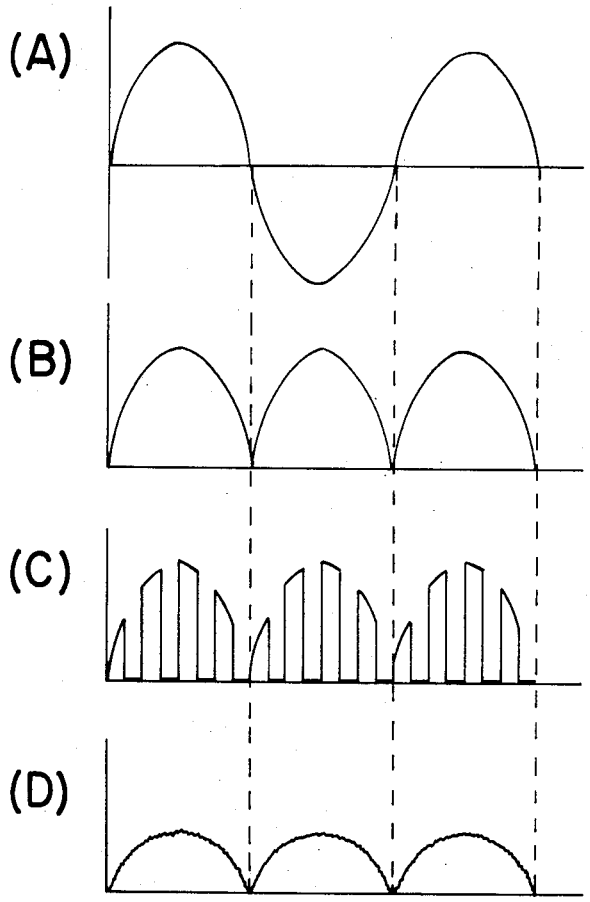
FIG. 3 illustrates waveforms of each portion of the circuit in FIG. 2 for the purpose of explaining its operation at input of 220 volts.

Referring now to FIG. 2, there is shown the circuit configuration of a 100 volt/220 volt compatible electromagnetic induction heating cooker constructed according to the present invention wherein the output terminal a of bridge diode 10 is connected via the filter comprising a choke coil L and a capacitor $C_3$ to a resonant capacitor $C_4$ and a work coil 30, and the collector of power transistor $Q_1$ is connected to the capacitor $C_4$ and the work coil 30 while the base of the transistor is connected to a control circuit 40.

In accordance with an aspect of the preferred embodiment constructed according to the present invention, the select switch $S_4$ and the switching transistor $Q_2$ are connected in parallel across the output a of bridge diode 10 and the input c of choke coil L; the output a and the output b of choke coil L are connected via resistors $R_1$ and $R_3$ to the grounded resistors $R_2$ and $R_4$, respectively, and also connected to the non-inverting and inverting input terminal of comparator 1; and then the output of comparator 1 is connected through an oscillator 2, a drive 3 and a select switch $S_2$ to the base of the transistor $Q_2$.

The unidentified symbol of drawings is defined as follows: $F_1$ is a power supply fuse, $S_1$ a power supply switch, M a ventilator, $S_3$ a switch for converting into its fixed terminals d and e in accordance with the input voltage of 100 volts or 220 volts, and 4 is the power supply circuit for providing a DC voltage for each portions of control circuit 40. Further, in case the switch $S_3$ is switched to its one fixed terminal d, the select switch $S_4$ is closed while the select switch $S_2$ is open, in response to such an operation. Alternately, if the switch $S_3$ is switched to its other fixed terminal e, the select switch $S_4$ is open while the select switch $S_2$ is closed, in response to such an operation.

The operation and working effects of the invention as described above will be explained in detail.

When a 220 volt AC voltage is input, the switch $S_3$ is switched into its fixed terminal e to open the select switch $S_4$ and to close the select switch $S_2$.

If the power supply switch $S_1$ is closed to input the AC voltage of 220 volts as shown in (A) of FIG. 3, the AC voltage is fullwave rectified in a bridge diode 10 to be output as shown in (B) of FIG. 3, and then the output voltage appears as zero volts at the node or contact point b between the choke coil L and the capacitor $C_3$.

Accordingly, since the voltage, $V_1$ applied to a non-inverting input terminal of comparator 1 is higher than the voltage, $V_2$ applied to an inverting input terminal of it thereby outputting a high-level signal at the output terminal of comparator 1, an oscillator 2 initiates the operation of oscillation and then the oscillated output signal of oscillator 2 conducts the transistor $Q_2$ through a drive 3 and a select switch $S_2$.

The switching transistor $Q_2$ is repeatedly rendered effective and ineffective in response to the high-level and low-level signals provided from the oscillator 2. Therefore, if the transistor Q2 is closed, there is provided current $I_1$ through choke coil L to raise the voltage at connection point b. And, if the transistor $Q_2$ is opened, there is provided a counterelectromotive force on the choke coil L to provide a positive voltage at the connection point b. The same counterelectromotive force charges a capacitor $C_3$ and causes current $I_2$ to flow through diode $D_2$. Thus, according to the switching transistor $Q_2$ being repeatedly rendered effective and ineffective, there is provided an output voltage waveform as shown in FIG. 3(c) for the connection point C which is the emitter of the transistor $Q_2$. The same output voltage appears in the waveform as shown in FIG. 3(D) on the connection point b through the choke coil L. Since the potential of the connection point b is dependent upon the open and closed times of the transistor $Q_2$, it is possible to yield at the connection point b the same output voltage as when AC 100 V input is applied by properly adjusting the oscillating period of the oscillator 2.

Furthermore, the values of resistors $R_1$, $R_2$, $R_3$ and $R_4$ are properly set so that the voltage $V_1$ applied to the non-inverting input terminal of the comparator 1 at a connection point between the resistors $R_1$ and $R_2$ is the same as the voltage $V_2$ applied to the inverting input terminal of the comparator 1 at a connection point between the resistors $R_3$ and $R_4$, provided that the output voltage of the connection point b is the same as 1/2.2 of the output voltage of the connection point a. Accordingly, in case the output voltage of the connection point b is higher than the 1/2.2 value of the output voltage of the connection point a, the voltage $V_2$ applied to the inverting input terminal of the comparator 1 becomes higher than the voltage $V_2$ applied to the non-inverting input terminal to provide a low-level signal on the output of the comparator 1. Thereby, the oscillator 2 is deactivated to maintain the transistor $Q_2$ to be opened and to lower the output voltage of the connection point b. Thus, when the output voltage of the connection point b is lowered and becomes lower than the 1/2.2 value of the output voltage of the connection point a, the voltage $V_2$ applied to the inverting input terminal becomes lower than the voltage $V_1$ applied to the non-inverting output voltage to provide a high-level signal on the output of the comparator 1. Therefore, the oscillator 2 is activated to repeatedly activate and deactivate the transistor $Q_2$ to raise the output voltage of the connection point b. By detecting the output voltage of the connection point b on the comparator 1 and controlling the same output voltage to be 1/2.2 of the output voltage of the connection point a, it is possible to apply to a resonant capacitor $C_4$ and a work coil 30 the same high-frequency current as when an AC 100 V input is applied. Accordingly, with a power transistor $Q_1$ being rendered effective and ineffective in response to the control signal of a control circuit 40, it will be able to provide the work coil 30 with the same high-frequency current as when an AC 100 V input is applied, generating magnetic lines of force.

On the one hand, if the switch $S_3$ is switched to its fixed terminal d to close the select switch $S_4$ and open the select switch $S_2$ at the input of 100 volt AC voltage, then the present circuit becomes the same configuration as the prior art 100 volt exclusive circuit and thus performs the same action as it.

In accordance with the present invention constructed and operated as described above, the electromagnetic induction heating cooker can be compatibly use at both 100 volts and 220 volt by converting the switch simply according to the 100 volt or 220 volt AC power supply.

While a preferred embodiment has been described, it is to be understood that modifications will be apparent to those skilled in the art without departing from the spirit of the invention.

What is claimed is:

1. An electomagnetic induction heating cooker compatible with a 100 volts input and a 220 volts input, comprising in combination:

an induction work coil connected in series with a choke coil;

a parallel circuit of a 100 V selecting switch and a transistor connected between an output terminal of a bridge diode and said choke coil;

a first pair of resistors connected in series to said output terminal of said bridge diode and a second pair of resistors connected in series to an output of said choke coil;

a comparator having a non-inverting input terminal connected to a connection point between said first pair of resistors and an inverting input terminal connected to a connection point between said second pair of resistors;

a series circuit of an oscillator, a driver and a 220 V selecting switch connected between an output of said comparator and a base of said transistor, said first and second pair of resistors being set so that equal voltages are applied to said non-inverting and inverting terminals of said comparator when the output voltage of said choke coil is 1/2.2 of an output voltage of said bridge diode, thereby enabling an application of a same voltage to said work coil by the proper switching of said switches when either an AC 100 V or 220 V input is applied.

2. An electromagnetic induction heating cooker compatible with two different input voltages, comprising in combination:

an induction work coil connected in series with a choke coil;

voltage input means for selectively supplying an input voltage having a value of either x volts or y volts;

switching means for transferring said input voltage to an input of said choke coil, said switching means including, x voltage selection switch, closed when said input voltage is x volts and open when said input voltage is y volts, y voltage selection switch, closed when said input voltage is y volts and open when said input voltage is x volts, and a third switch, actuable when said y voltage selection switch is closed; and drive means, connected to said y voltage selection switch, for controlling an ON/OFF state of said third switch, said drive means repeatedly turning said third switch ON and OFF so as to assure that an output voltage of said choke coil when said input voltage equals x volts is equal to an output voltage of said choke coil when said input voltage equals y volts.

3. The cooker of claim 2, wherein said drive means comprises:

means for comparing a first voltage dependent upon said input voltage, and a second voltage dependent upon said output voltage of said choke coil and producing a difference signal indicative of the comparison; and an oscillator, responsive to said difference signal, that produces a switching signal that controls the ON/-OFF state of said third switch when said switching signal varies in accordance with changes in said difference signal.

4. The cooker of claim 3, wherein said first voltage equals said second voltage when:

output voltage=(x/y) input voltage.

5. The cooker of claim 4 wherein $x<y$.

6. The cooker of claim 3 wherein said third switch is a power transistor.

7. The cooker of claim 3 wherein said first voltage is produced by a voltage division of said input voltage by a first plurality of resistances and said second voltage is produced by a voltage division of said output voltage of said choke coil by a second plurality of resistances.

* * * * *